US009335087B2

(12) United States Patent
Hwang et al.

(10) Patent No.: US 9,335,087 B2
(45) Date of Patent: May 10, 2016

(54) REFRIGERATOR HAVING ICE MAKING DEVICE

(75) Inventors: Gwi-Nan Hwang, Changwon (KR); Ju-Hyun Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 181 days.

(21) Appl. No.: 13/258,950

(22) PCT Filed: Apr. 1, 2009

(86) PCT No.: PCT/KR2009/001673

§ 371 (c)(1),
(2), (4) Date: Sep. 22, 2011

(87) PCT Pub. No.: WO2010/114186

PCT Pub. Date: Oct. 7, 2010

(65) Prior Publication Data

US 2012/0017626 A1 Jan. 26, 2012

(51) Int. Cl.

| | |
|---|---|
| ***F25C 1/22*** | (2006.01) |
| ***F25C 5/18*** | (2006.01) |
| ***F25C 1/00*** | (2006.01) |

(Continued)

(52) U.S. Cl.

CPC . *F25D 23/04* (2013.01); *F25C 1/24* (2013.01); *F25C 5/185* (2013.01); *F25C 1/08* (2013.01); *F25C 1/10* (2013.01); *F25C 1/22* (2013.01); *F25C 2400/06* (2013.01); *F25C 2500/02* (2013.01); *F25C 2500/06* (2013.01); *F25D 2323/023* (2013.01)

(58) Field of Classification Search

CPC ..... F25C 1/10; F25C 1/08; F25C 1/22; F25C 1/24

USPC ..... 62/340, 344, 353, 377

See application file for complete search history.

(56) References Cited

U.S. PATENT DOCUMENTS 3,159,985 A * 12/1964 Keighley ..... 62/344
5,809,797 A * 9/1998 Ryu ..... 62/340

(Continued)

FOREIGN PATENT DOCUMENTS

DE 20206409 U1 * 8/2002 ..... F25C 1/243
KR 1992-0006289 Y1 9/1992

(Continued)

OTHER PUBLICATIONS

International Search Report and Written Opinion issued in PCT Application No. PCT/KR2009/001673 dated Dec. 24, 2009.

*Primary Examiner* — Frantz Jules
*Assistant Examiner* — Steve Tanenbaum
(74) *Attorney, Agent, or Firm* — Ked & Associates, LLP

(57) ABSTRACT

A refrigerator having an ice making device, comprises: a case having an opening at one side thereof; a tray accommodation portion having opened upper and lower surfaces, and configured to be inserted into or withdrawn from the case through the opening; an ice tray accommodated in the tray accommodation portion, and containing water to be frozen to ice cubes; and an accommodation portion coupling unit for coupling the tray accommodation portion to the case. Water is poured onto the ice tray in a state that the ice tray has been accommodated in the tray accommodation portion, and then the ice tray is carried to be mounted to the case. This may solve the conventional problem that each ice tray has to be carried. Furthermore, since an external force such as hand trembling is transmitted to the ice tray via the tray accommodation portion, overflow of water is minimized.

18 Claims, 12 Drawing Sheets

(51) Int. Cl.

| | |
|---|---|
| ***F25D 25/00*** | (2006.01) |
| ***F25D 23/04*** | (2006.01) |
| ***F25C 1/24*** | (2006.01) |
| *F25C 1/10* | (2006.01) |
| *F25C 1/08* | (2006.01) |

(56) References Cited

U.S. PATENT DOCUMENTS

| | | | | |
|---|---|---|---|---|
| 5,810,662 | A * | 9/1998 | Van Becelaere | A62C 2/14 454/284 |
| 5,946,924 | A * | 9/1999 | Kim | 62/189 |
| 6,216,471 | B1 * | 4/2001 | Patrick | F25C 1/04 62/353 |
| 6,481,235 | B2 * | 11/2002 | Kwon | 62/353 |
| 7,010,934 | B2 * | 3/2006 | Choi et al. | 62/353 |
| 2001/0025505 | A1 * | 10/2001 | Nelson et al. | 62/371 |
| 2006/0112715 | A1 * | 6/2006 | Chung | 62/340 |
| 2007/0012061 | A1 * | 1/2007 | Ribeiro et al. | 62/344 |
| 2007/0283714 | A1 * | 12/2007 | Yoon et al. | 62/340 |
| 2008/0006048 | A1 * | 1/2008 | Yoon et al. | 62/345 |
| 2008/0209936 | A1 * | 9/2008 | Kim | F25C 1/10 62/340 |
| 2008/0289355 | A1 * | 11/2008 | Kang | F25C 1/24 62/344 |
| 2009/0007585 | A1 * | 1/2009 | Kim et al. | 62/353 |
| 2009/0038330 | A1 * | 2/2009 | Lee | F25C 1/04 62/344 |
| 2009/0178431 | A1 * | 7/2009 | Cho | 62/345 |

FOREIGN PATENT DOCUMENTS

| | | | | |
|---|---|---|---|---|
| KR | 10-1999-0049524 | | 7/1999 | |
| KR | 10-2001-0109571 | A | 12/2001 | |
| KR | 20-0297400 | Y1 | 12/2002 | |
| KR | 10-2004-0085606 | | 10/2004 | |
| KR | 10-2005-0110213 | | 11/2005 | |
| KR | 10-0765201 | | 10/2007 | |
| KR | 10-2008-0001321 | A | 1/2008 | |
| KR | 10-2008-0103550 | A | 11/2008 | |
| WO | WO 2008030020 | A2 * | 3/2008 | F25C 1/10 |

* cited by examiner

REFRIGERATOR HAVING ICE MAKING DEVICE

TECHNICAL FIELD

The present invention relates to a refrigerator, and more particularly, to a refrigerator having an ice making device configured to make ice cubes and store them.

BACKGROUND ART

Generally, a refrigerator is an apparatus for maintaining food items with a fresh state for a long time by supplying cool air generated by a refrigerating cycle to a storage chamber.

The refrigerator comprises a body having a storage chamber for storing food items therein, and a door by which the storage chamber is opened and closed to store food items therein.

The refrigerator generates cool air to maintain food items stored in the storage chamber at a low temperature, by a refrigerating cycle composed of compression, condensation, expansion, and evaporation processes for a refrigerant.

Recently, most of refrigerators are respectively provided with an ice making device for making ice cubes and storing them so as to enhance a user's convenience.

The ice making device for the conventional refrigerator includes an ice tray for containing water to be frozen therein, a housing mounted with the ice tray and having a storage chamber, an ice-cube storage container for storing frozen ice cubes, etc.

A user separates the ice tray from the housing, and supplies water to the ice tray with holding the ice tray. Then, the user mounts the ice tray to inside of the housing.

However, while mounting the ice tray to inside of the housing, water may be discharged out of the ice tray due to an inclined state of the ice tray or hand trembling, etc. This may cause inside of the housing to be contaminated.

Furthermore, since water is biased to an inclined direction of the ice tray, ice cubes may be made with small and non-uniform sizes.

Especially, when the ice making device is provided with a plurality of ice trays, the respective ice trays have to be separated from the housing one by one, and then mounted to the housing. In this case, the above problems become more severe.

In order to solve the problems, has been disclosed a method for supplying water to the ice tray by using a water tank in a state that the ice tray has been coupled to the housing.

According to the method, once the water tank having water therein is coupled to the housing, the water is supplied to the ice tray through a valve opened upon the coupling between the water tank and the housing.

However, in this case, a water tank having a valve device has to be additionally provided. This may increase the cost of the refrigerator.

Furthermore, since the valve device and the water tank can not be easily cleaned, water or ice cubes may be contaminated.

Besides, ice cubes are taken out of the refrigerator by withdrawing the ice-cube storage container by opening the door. This may cause a user's inconvenience, and cool air may be leaked while the door is opened and closed, resulting in increase of power consumption.

DISCLOSURE OF INVENTION

Technical Problem

Therefore, it is an object of the present invention to provide a refrigerator having an ice making device capable of minimizing overflow of water in a process for coupling an ice tray having water contained therein to a housing.

It is another object of the present invention to provide a refrigerator having an ice making device capable of minimizing leakage of cool air from a storage chamber when taking out ice cubes.

Technical Solution

To achieve these and other advantages and in accordance with the purpose of the present invention, as embodied and broadly described herein, there is provided a refrigerator having an ice making device, comprising: a case having an opening at one side thereof; a tray accommodation portion having opened upper and lower surfaces, and configured to be inserted into or withdrawn from the case through the opening; an ice tray accommodated in the tray accommodation portion, and containing water to be frozen to ice cubes; and an accommodation portion coupling unit for coupling the tray accommodation portion to the case.

The accommodation portion coupling unit may be implemented as a locking protrusion formed at one of the tray accommodation portion and the case, and a locking hook formed at another thereof.

The tray accommodation portion may be disposed so that a bottom surface thereof can be parallel to an upper surface thereof having the ice tray accommodated therein. And, the bottom surface of the tray accommodation portion may be disposed below a lowermost surface of the ice tray.

The ice tray may include a plurality of ice pockets each configured to make one ice cube by containing water of a predetermined height (H); pocket communication portions for supplying water contained in any ice pocket with a height more than the predetermined height (H), by an excessive amount, to adjacent ice pockets; and a discharge portion for discharging excessively supplied water, by an excessive amount, to the outside when all of the ice pockets contain water of the predetermined height (H).

The tray accommodation portion may be implemented so as to accommodate one or more ice trays therein, each ice tray formed in a rectangular shape and having long sides in right and left directions of the case.

The refrigerator may further comprise a tray rotation unit for rotating the ice tray upside down so that ice cubes can be separated from the ice tray.

The refrigerator may further comprise an ice-cube storage container disposed below the tray accommodation portion, for storing ice cubes separated from the ice tray.

The case may be mounted on a rear surface of the door of the refrigerator, by the door a storage chamber is selectively opened or closed.

Advantageous Effects

The refrigerator having an ice making device according to the present invention has the following advantages.

Water is poured onto the ice tray in a state that the ice tray has been accommodated in the tray accommodation portion. Then, the ice tray is carried to be mounted to the case. This may solve the conventional problem that each ice tray has to be carried for mounting.

Also, since an external force such as hand trembling is transmitted to the ice tray via the tray accommodation portion, overflow of water is minimized.

Furthermore, the tray accommodation portion is fixed to the case by the accommodation portion coupling unit. Accordingly, overflow of water due to an external force applied to the refrigerator can be prevented even in a state that the ice tray has been mounted to the refrigerator.

Furthermore, since ice cubes are separated from the ice tray by the tray rotation unit, can be solved the conventional problem that the ice tray has to be withdrawn for separation of ice cubes.

Furthermore, the ice tray is accommodated in the case so that a length direction of the ice tray is disposed in right and left directions of the case. Accordingly, a width of the case, that is, a thickness of the ice making device can be reduced, which expands spaces inside the storage chamber.

Here, the spaces inside the storage chamber can be expanded by installing the case on a rear surface of the door.

Furthermore, the door is provided with an ice-cube withdrawing door, can be minimized cool air leakage occurring when the door is opened or closed so as to take out ice cubes.

BEST MODE FOR CARRYING OUT THE INVENTION

Reference will now be made in detail to the preferred embodiments of the present invention, examples of which are illustrated in the accompanying drawings.

Hereinafter, a refrigerator having an ice making device according to a first embodiment of the present invention will be explained in more detail.

Figure 1:
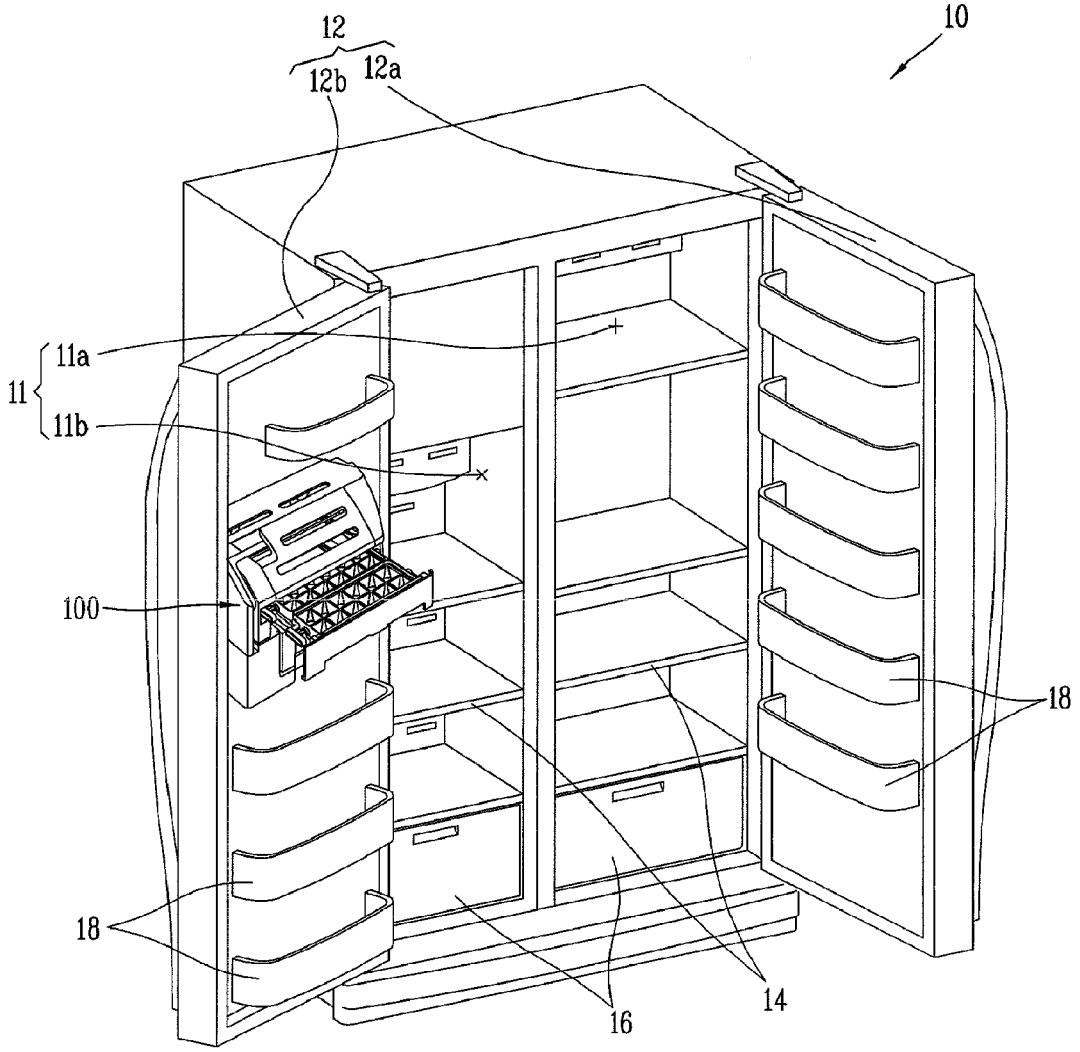
FIG. 1 is a perspective view showing a refrigerator having an ice making device according to a first embodiment of the present invention.

FIG. 1 is a perspective view showing a refrigerator having an ice making device according to a first embodiment of the present invention.

Referring to FIG. 1, a refrigerator 10 according to the present invention comprises a storage chamber 11 divided into a refrigerating chamber 11*a* and a freezing chamber 11*b*.

The storage chamber 11 is shielded from the outside by a wall body having an insulating material therein.

Each of the refrigerating chamber 11*a* and the freezing chamber 11*b* has one opened surface through which food items can be inserted thereinto or discharged therefrom. The opened surfaces of the refrigerating chamber 11*a* and the freezing chamber 11*b* are opened or closed by a refrigerating chamber door 12*a* and a freezing chamber door 12*b*, respectively.

FIG. 1 shows the refrigerator 10 in which the refrigerating chamber 11*a* and the freezing chamber 11*b* are disposed side by side in a horizontal direction, and the refrigerating chamber door 12*a* and the freezing chamber door 12*b* are hinge-coupled to a wall body that forms the refrigerating chamber 11*a* and the freezing chamber 11*b*. The refrigerating chamber door 12*a* and the freezing chamber door 12*b* are rotated to open or close the opened surfaces of the refrigerating chamber 11*a* and the freezing chamber 11*b*.

However, the refrigerator 10 of the present invention is not limited to the refrigerator shown in FIG. 1.

That is, the refrigerator 10 of the present invention may be implemented as a refrigerator in which the refrigerating chamber 11*a* is disposed at an upper or lower side whereas the freezing chamber 11*b* disposed at a lower or upper side. Here, the refrigerating chamber door 12*a* or the freezing chamber door 12*b* may be disposed to perform a sliding motion in a thickness direction of the refrigerator 10. The refrigerator 10 of the present invention may be also implemented as a refrigerator having only the freezing chamber 11*b*.

Referring to FIG. 1, the storage chamber 11 of the refrigerator 10 is provided with shelves 14 on which food items are put, drawer-type storage means 16, etc. And, the refrigerating chamber door 12*a* and the freezing chamber door 12*b* are provided with pocket-type storage means 18.

The ice making device 100 of the refrigerator 10 may be disposed inside the freezing chamber 11*b*, or at the freezing chamber door 12*b* as shown in FIG. 1.

A structure that the ice making device 100 is installed at the freezing chamber door 12*b* will be explained in more detail.

Figure 2:
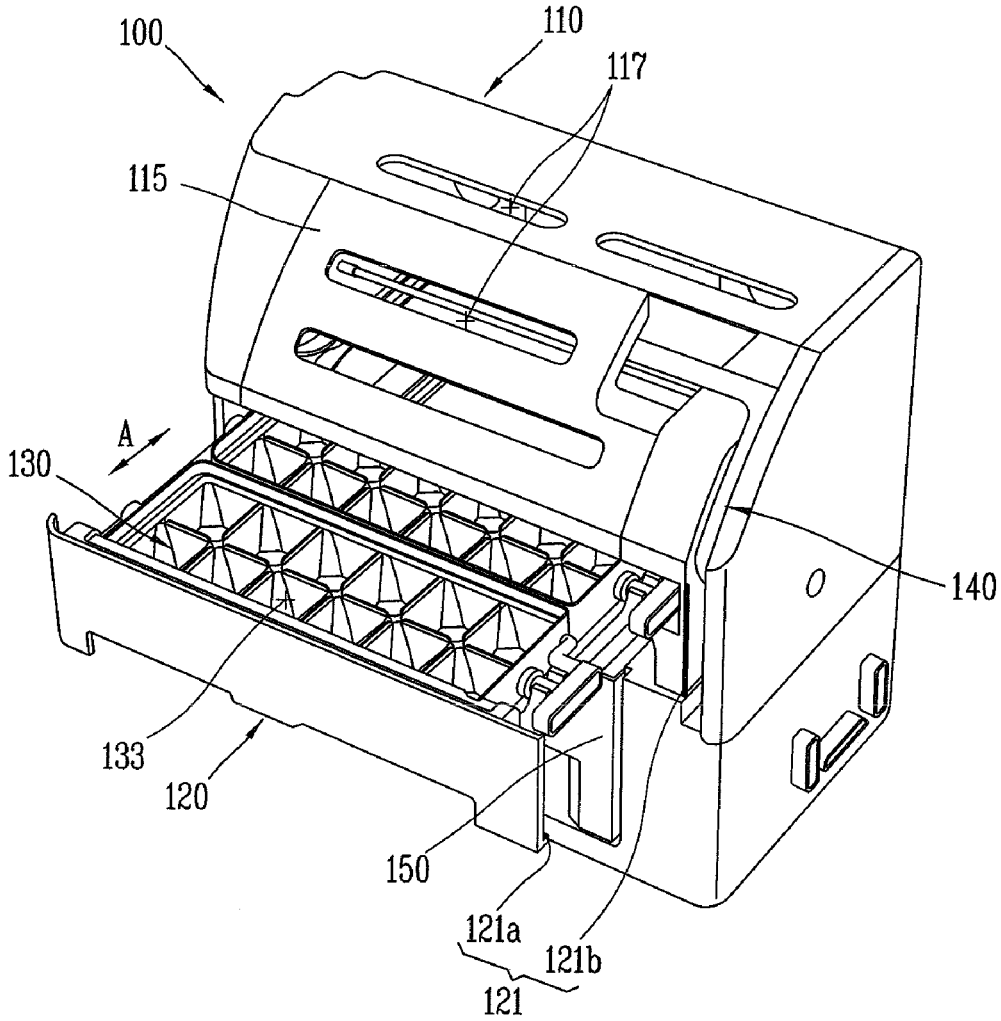
FIG. 2 is a perspective view showing the ice making device of FIG. 1.

FIG. 2 is a perspective view showing the ice making device of FIG. 1.

Referring to FIG. 2, the ice making device 100 includes a case 110 that forms the appearance, a tray accommodation portion 120 inserted into or withdrawn from the case 110, an ice tray 130 accommodated in the tray accommodation portion 120, and an accommodation portion coupling unit 121 for coupling the tray accommodation portion 120 to the case 110 when inserting the tray accommodation portion 120 to the case 110.

The case 110 is formed in a hexagonal shape, and is provided with cool air through holes 117 through which cool air is introduced thereinto.

An opening 113 through which the tray accommodation portion 120 is inserted into or withdrawn from the case 110 is formed on a front surface of the case 110. Here, the position of the opening 113 may be modified by a designer.

Preferably, a transparent portion 115 formed of a transparent material is disposed on an upper region of the case 110 so that a user can check, from outside of the case 110, a state of the ice tray 130 having been inserted into the case 110, i.e., whether water contained in the ice tray 30 has been frozen.

The tray accommodation portion 120 is formed to have a predetermined height, and is formed in a rectangular ring shape having opened upper and lower surfaces.

The ice tray 130 is accommodated at an upper end of the tray accommodation portion 120.

The ice tray 130 is implemented as a vessel to contain water therein, and is inserted into the case 110 in an accommodated state into the tray accommodation portion 120.

The accommodation portion coupling unit 121 fixes the tray accommodation portion 120 to the case 110 when inserting the tray accommodation portion 120 into the case 110, thereby preventing the tray accommodation portion 120 from moving.

The accommodation portion coupling unit 121 will be explained in more detail with reference to FIGS. 3 to 5.

Figure 3:
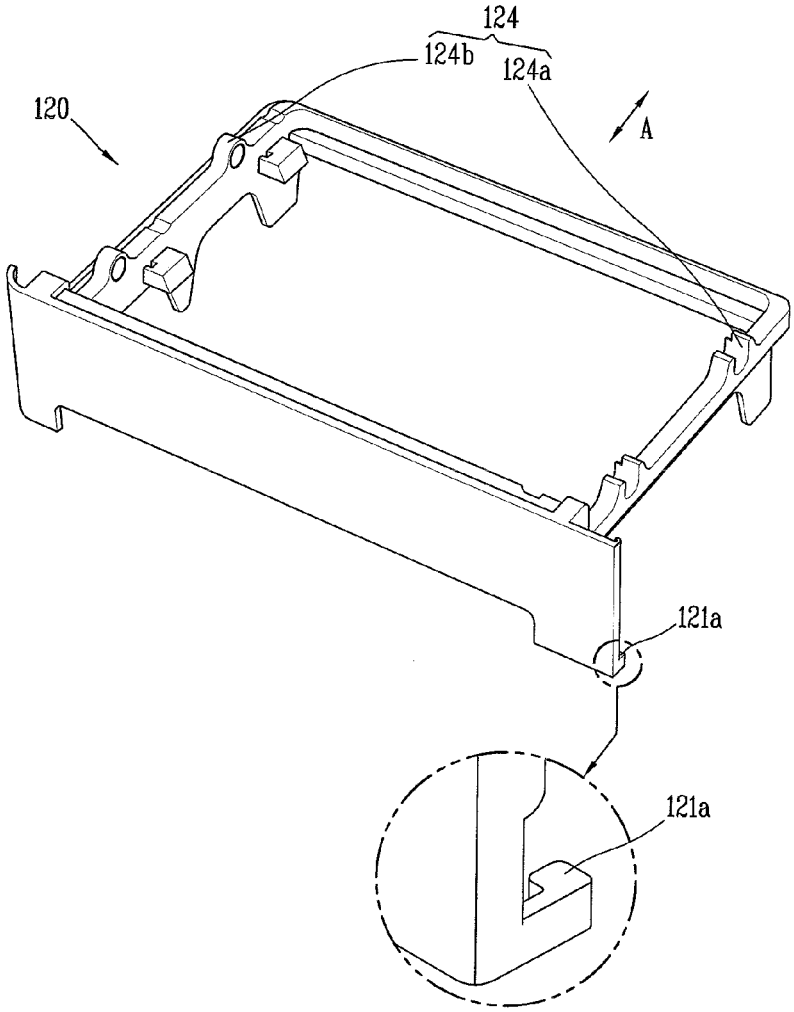
FIG. 3 is a view showing one example of an accommodation portion coupling unit of FIG. 2.
Figure 4:
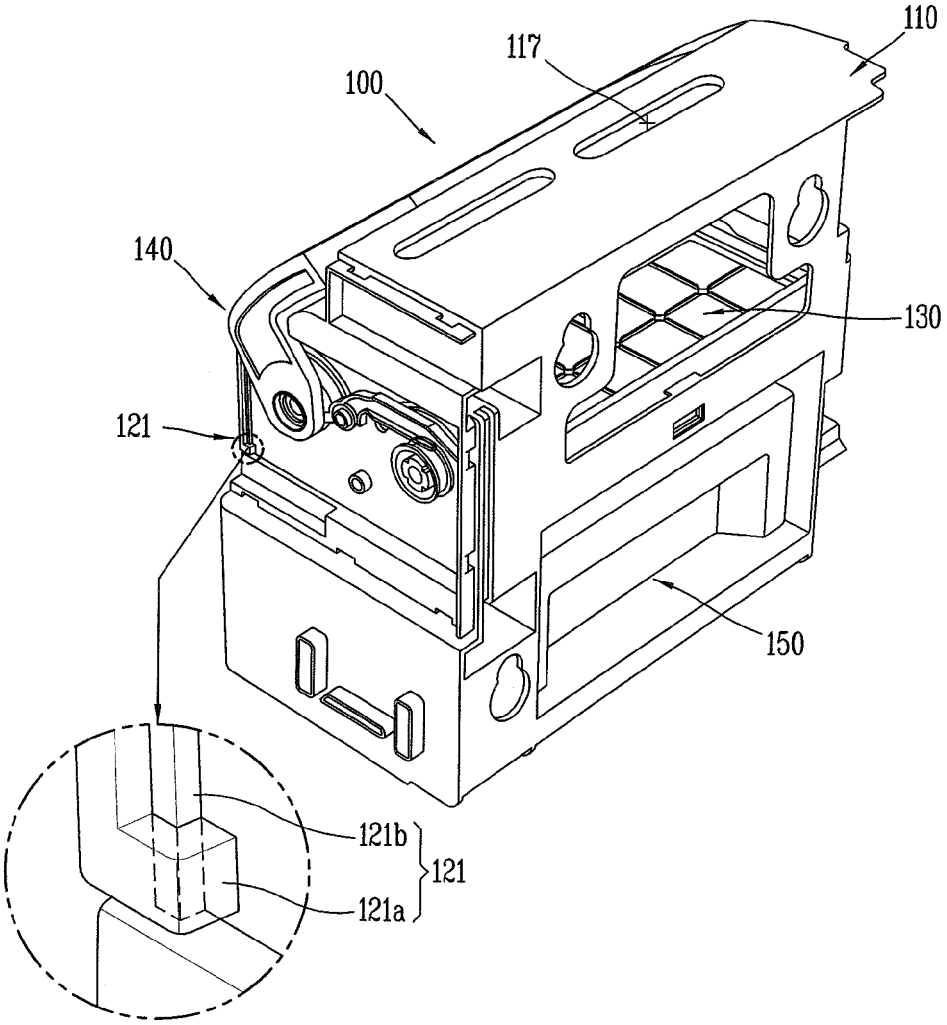
FIG. 4 is a view showing a coupled state between a tray accommodation portion and a case of FIG. 3.
Figure 5:
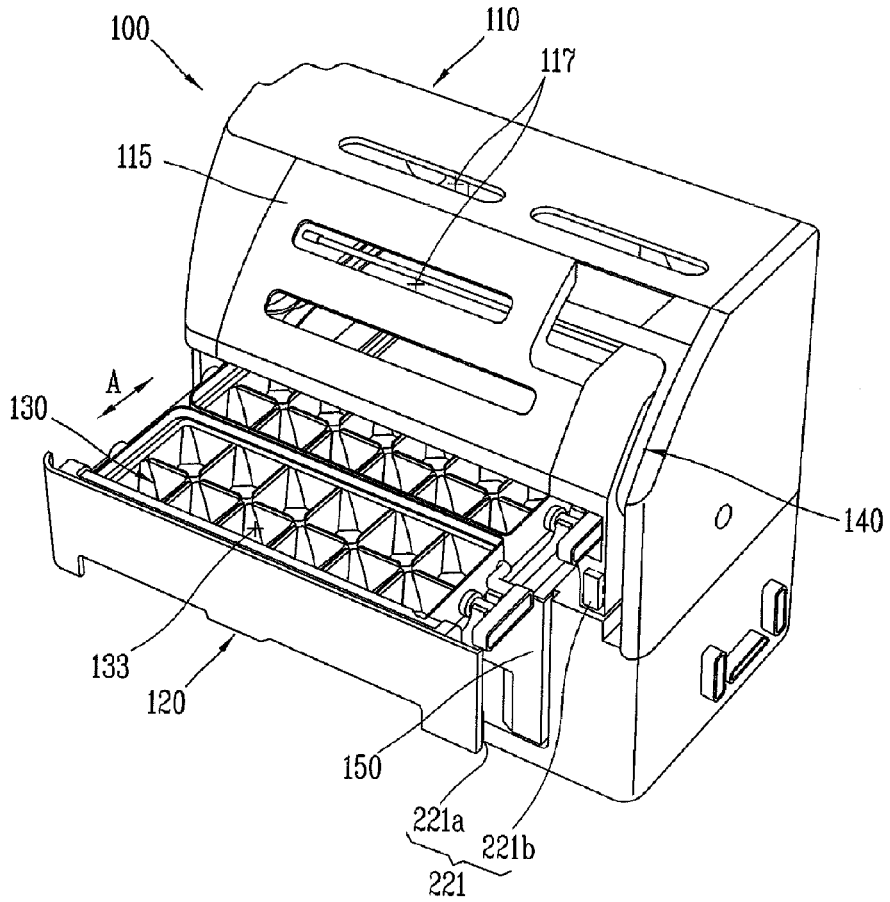
FIG. 5 is a view showing another example of the accommodation portion coupling unit of FIG. 2.

FIG. 3 is a view showing one example of an accommodation portion coupling unit of FIG. 2, FIG. 4 is a view showing a coupled state between a tray accommodation portion and a case of FIG. 3, and FIG. 5 is a view showing another example of the accommodation portion coupling unit of FIG. 2.

Referring to FIGS. 3 and 4, the accommodation portion coupling unit 121 includes a locking hook 121*a* formed at the tray accommodation portion 120, and a locking protrusion 121*b* formed at the case 110 and coupled to the locking hook 121*a* when inserting the tray accommodation portion 120 into the case 110.

Here, the positions of the locking hook 121*a* and the locking protrusion 121*b* may be interchanged from each other.

Under an assumption that inserting and withdrawing directions of the tray accommodation portion 120 into/from the case 110 are back and forth directions, the accommodation portion coupling unit 121 is preferably provided on each end surface of the case 110 in right and left directions.

Referring to FIG. 5, an accommodation portion coupling unit 221 may be provided at opposite positions of the tray accommodation portion 120 and the case 110 when inserting the tray accommodation portion 120 into the case 110, and may be implemented as permanent magnets having attractive forces applied thereto.

Preferably, the accommodation portion coupling unit 121 shown in FIGS. 3 and 4, and the accommodation portion coupling unit 221 shown in FIG. 5 serve to couple the tray accommodation portion 120 to the case 110 upon inserting the tray accommodation portion 120 into the case 110, but serves to separate the tray accommodation portion 120 from the case 110 upon withdrawing the tray accommodation portion 120 from the case 110.

The tray accommodation portion 120 is disposed so that a bottom surface thereof can be parallel to an upper end thereof having the ice tray 130 accommodated therein.

And, the bottom surface of the tray accommodation portion 120 is positioned below a lowermost surface of the ice tray 130.

In a state that the ice tray 130 has been accommodated in the tray accommodation portion 120, once the tray accommodation portion 120 is positioned on a horizontal surface, the ice tray 130 automatically maintains a horizontal state. This may allow water to be supplied to the ice tray 130 with the same height.

Next, the ice tray 130 will be explained in more detail with reference to FIGS. 6 to 9.

Figure 6:
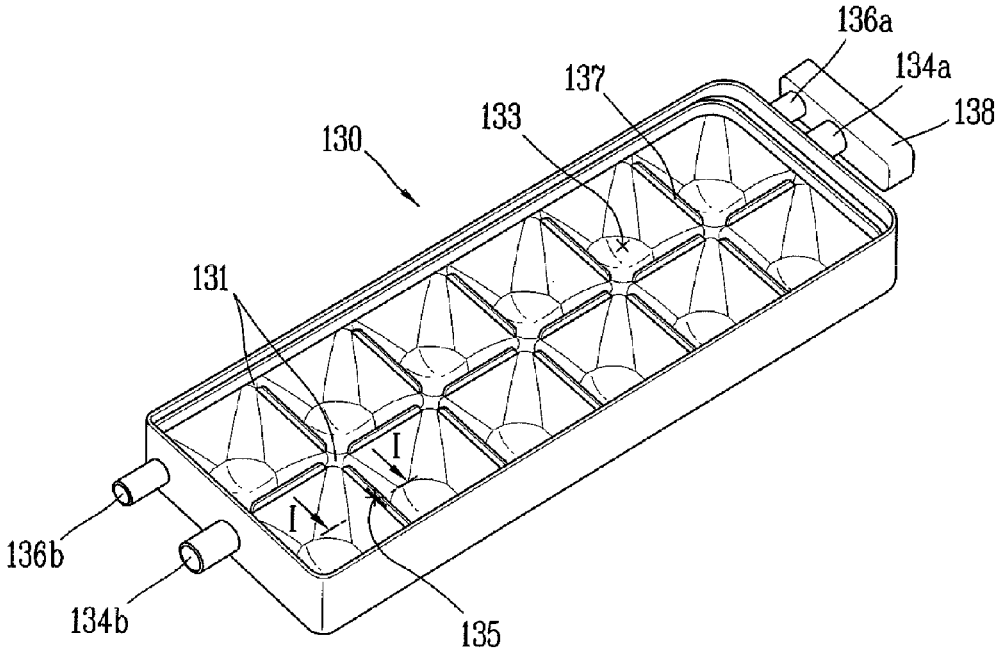
FIG. 6 is a disassembled perspective view of an ice tray of FIG. 2.
Figure 7:
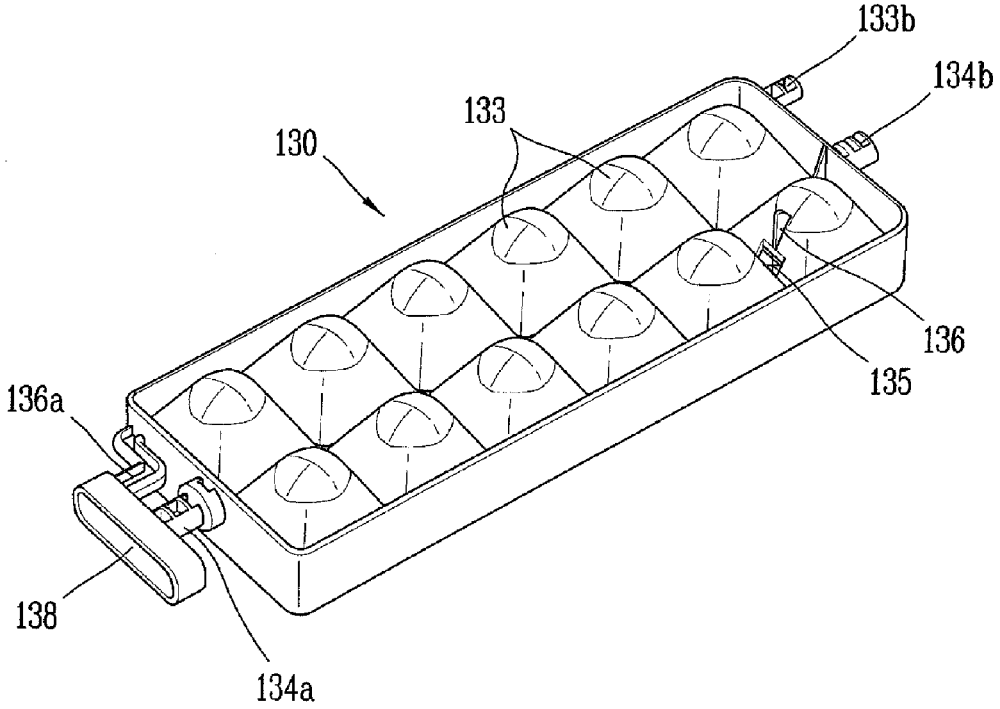
FIG. 7 is a perspective view showing a bottom surface of the ice tray of FIG. 6.
Figure 8:
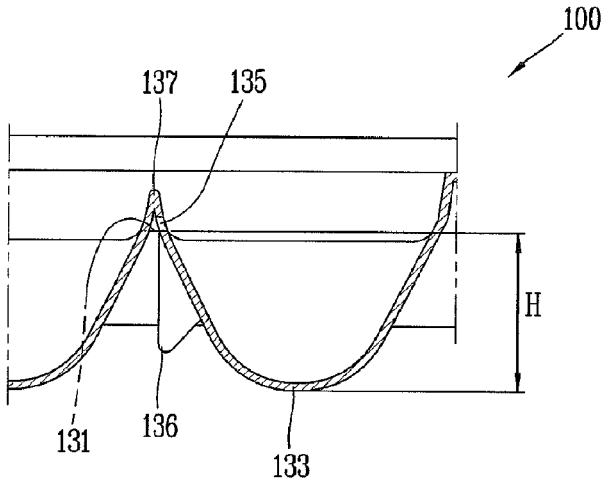
FIG. 8 is a sectional view taken along line 'I-I' in FIG. 6.
Figure 9:
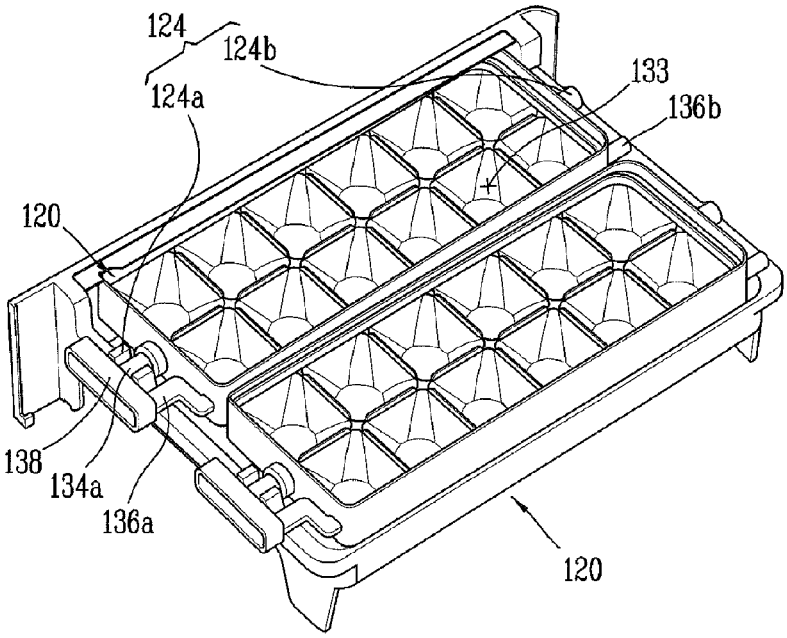
FIG. 9 is a view showing a coupled state between the tray accommodation portion and the ice tray of FIG. 2.

FIG. 6 is a disassembled perspective view of an ice tray of FIG. 2, FIG. 7 is a perspective view showing a bottom surface of the ice tray of FIG. 6, FIG. 8 is a sectional view taken along line 'I-I' in FIG. 6, and FIG. 9 is a view showing a coupled state between the tray accommodation portion and the ice tray case of FIG. 2.

Referring to FIGS. 6 to 8, the ice tray 130 may include a plurality of ice pockets 133 where ice cubes are frozen, pocket communication portions 131 and a discharge portion 135 which are configured to limit water to be contained in the ice pockets 133 with a height within a predetermined height (H).

The ice pockets 133 are formed as inside of the ice tray 130 is divided into a plurality of parts. Each of the ice pockets 133 contains a predetermined amount of water therein, thereby forming one ice cube.

The amount of water supplied to the respective ice pockets 133 may be constantly set based on a height of water.

In the case that water is excessively supplied to any ice pocket 133 with a height more than a predetermined height (H), the water is made to flow to the adjacent ice pockets 133, by the excessive amount, through the pocket communication portions 131.

The pocket communication portions 131 may be implemented as grooves formed on upper ends of partition portions 137. The partition portions 137 serve to partition the ice pockets 133 from each other so that one ice pocket 133 can be communicated with its adjacent ice pockets at a position higher than the predetermined height (H).

Preferably, the pocket communication portions 131 are implemented not as holes, but as grooves upwardly opened so as to prevent a resistance against a flowing direction of water to the adjacent pockets 133.

The ice pockets 133 further comprise a discharge portion 135 for discharging water excessively supplied with a height more than the predetermined height (H) to the outside by the excessive height.

The discharge portion 135 serves to discharge water to the outside of the ice tray 130 therethrough when water is continuously supplied to the ice pockets 133 in a state the ice pockets 133 contain water of the predetermined height (H).

The discharge portion 135 is formed at one or more ice pockets 133, and is implemented as a hole penetratingly formed at the partition portion 137 of the ice pocket 133.

The discharge portion 135 serves to discharge water supplied with a height more than the predetermined height (H). Accordingly, the discharge portion 135 is preferably disposed just above the predetermined height (H).

Water having passed through the discharge portion 135 is discharged to a bottom surface of the ice tray 130.

Preferably, the refrigerator having an ice making device further comprises a drain guide rib 136 for guiding water having passed through the discharge portion 135 so as to prevent the water from being splashed to a lower side of the ice tray 130.

Preferably, the drain guide rib 136 is formed on a lower surface of the ice tray 130, and is disposed so as to be extending from the discharge portion 135 to a lower side of the ice tray 130 in a height direction of the ice tray 130.

In order to prevent water from being splashed, the drain guide rib 136 is preferably formed so that an end portion thereof can be extending up to a bottom surface of the tray accommodation portion 120.

Referring to FIG. 9, the ice tray 130 is formed in a rectangular shape. And, the ice tray 130 is accommodated in the tray accommodation portion 120 so that a length direction thereof can be positioned in right and left directions of the case 110.

Rotation protrusions 134*a* and 134*b* are protruding from both side surfaces of the ice tray 130 in a length direction of the ice tray 130.

The rotation protrusions 134*a* and 134*b* are detachably coupled to accommodation grooves 124 disposed on upper ends of both side surfaces of the tray accommodation portion 120.

Under these configurations, the ice tray 130 is prevented from moving with respect to the tray accommodation portion 120. And, the ice tray 130 is rotated about the rotation protrusions 134*a* and 134*b* in back and forth directions of the tray accommodation portion 120.

The ice tray 130 is further provided with rotation limiting protrusions 136*a* and 136*b* protruding from both side surfaces of the ice tray 130 in a length direction with a spacing distance from the rotation protrusions 134*a* and 134*b* in a widthwise direction of the ice tray 130.

The rotation limiting protrusions 136*a* and 136*b* allow the ice tray 130 to be rotated in one direction, and limit a rotation angle of the ice tray 130 into about 180°.

Furthermore, the rotation limiting protrusions 136*a* and 136*b* prevent the ice tray 130 from being rotated while water is contained into the ice tray 130.

One rotation protrusion 134*a* and one rotation limiting protrusion 136*a* formed on one side surface of the ice tray 130 are coupled to each other by a shaft coupling portion 138 long formed in a width direction of the ice tray 130.

Once a rotational force is applied to the shaft coupling portion 138, the ice tray 130 is rotated. Then, the rotation limiting protrusions 136*a* and 136*b* limit the rotation of the ice tray 130 when the ice tray 130 has been rotated upside down.

In order to provide a torsional force to the ice tray 130, the rotation limiting protrusion 136*a* formed on one side surface of the ice tray where the shaft coupling portion 138 is formed is preferably disposed at a lower part of the ice tray 130, based on a height of the ice tray 130, than the rotation limiting protrusion 134*b* formed on another side surface of the ice tray 130.

While the ice tray 130 is rotated, the rotation limiting protrusion 136*b* disposed on one side surface of the ice tray 130 where the shaft coupling portion 138 is not provided are firstly locked by an upper end of the tray accommodation portion 120 than the rotation limiting protrusions 136*a* disposed on another side surface of the ice tray 130 where the shaft coupling portion 138 is provided. Under this state, once the shaft coupling portion 138 is further rotated, an angular displacement occurs in a length direction of the ice tray 130. Accordingly, the ice tray 130 is twisted, thereby facilitating separation of ice cubes from the ice tray 130.

Since the rotation limiting protrusion 136*a* connected to the shaft coupling portion 138 are disposed at a lower part of the ice tray 130, based on a height of the ice tray 130, than the rotation limiting protrusion 136*b* where the shaft coupling portion 138 is not provided, may occur a problem that the ice tray 130 having been accommodated in the tray accommodation portion 120 may not maintain a horizontal state. However, this problem can be solved by bending the rotation limiting protrusion 136*a* a plurality of times as shown in FIG. 9.

The ice making device 100 may further include a tray rotation unit 140 for rotating the ice tray 130 (refer to FIGS. 4 and 5).

The tray rotation unit 140 will be explained in more detail with reference to FIGS. 10 and 11.

Figure 10:
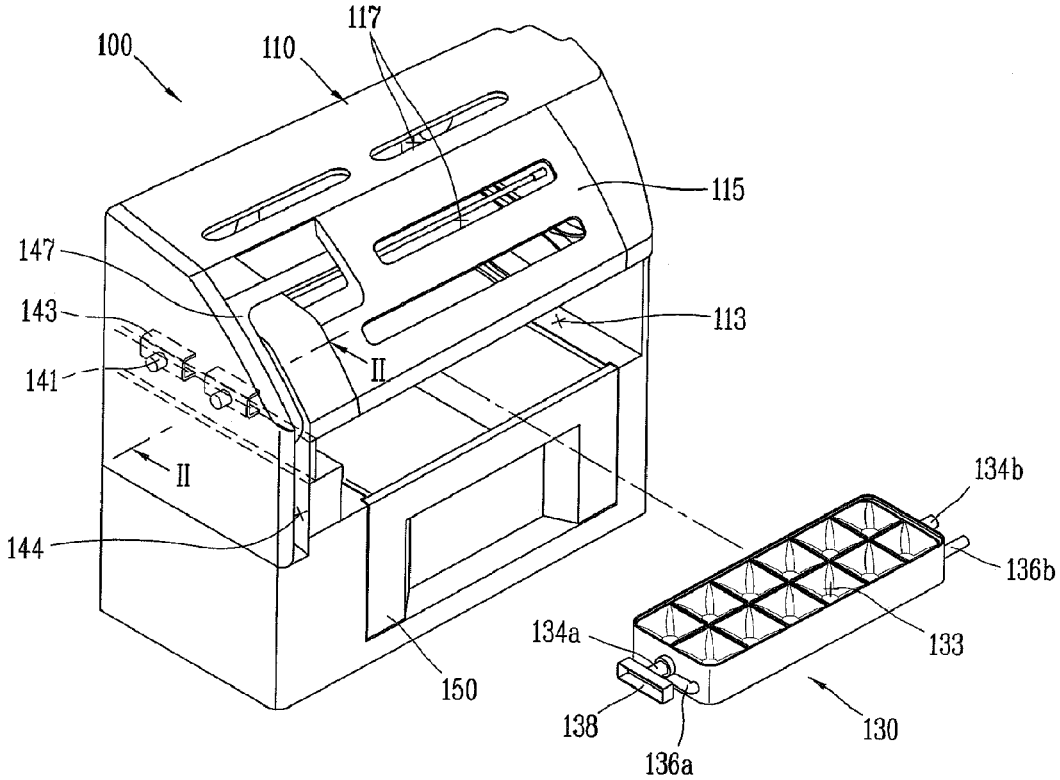
FIG. 10 shows a tray rotation unit of FIG. 2 viewed from inside of the case.
Figure 11:
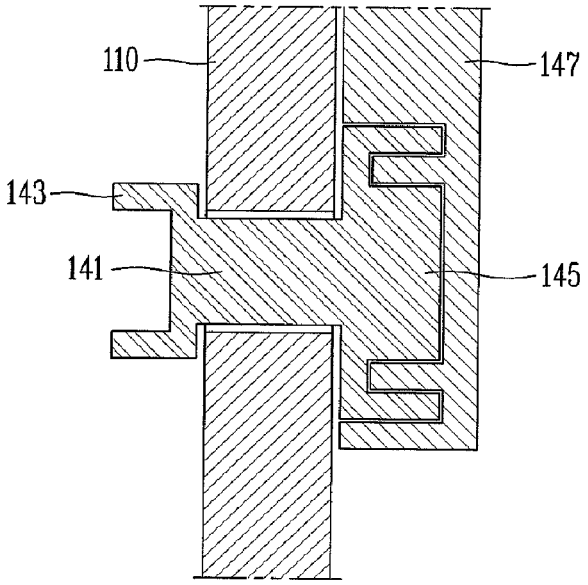
FIG. 11 is a sectional view taken along line 'II-II' in FIG. 10.

FIG. 10 shows the tray rotation unit of FIG. 2 viewed from inside of the case, and FIG. 11 is a sectional view taken along 'line II-II' in FIG. 10.

Referring to FIG. 10, the tray rotation unit 140 rotates the ice tray 130 by providing a rotational force to the shaft coupling portion 138 disposed on one side surface of the ice tray 130.

Referring to FIGS. 10 and 11, the tray rotation unit 140 includes rotation shafts 141 coupled to the ice trays 130 when the tray accommodation portion 120 is inserted into the case 110, for rotating the ice trays 130 by receiving a rotational force applied to each one end thereof; and a lever 147 for supplying a rotational force to the rotation shafts 141.

The rotation shaft 141 is penetratingly formed on a side surface of the case 110, and is disposed so as to be rotatably supported by the case 110.

A tray coupling portion 143 detachably coupled to the shaft coupling portion 138 of the ice tray 130 is formed on one end of the rotation shaft 141 disposed inside the case 110.

The tray coupling portion 143 and the shaft coupling portion 138 may be implemented as a slot and a protrusion detachably coupled to each other. Preferably, the slot is horizontally formed in a width direction of the case 110 so as to be coupled to the tray coupling portion 143 while the tray accommodation portion 120 is inserted into the case 110.

A lever coupling portion 145 coupled to the lever 147 is provided on another end of the rotation shaft 141 disposed outside the case 110.

End portions of the lever coupling portion 145 and the lever 147 coupled to each other may be implemented as a protrusion and a groove each having a polygonal sectional shape in a width direction of the case 110 and coupled to each other.

The ice making device 100 may further include a rotation unit cover 148 for covering the lever 147 and the lever coupling portion 145 disposed outside the case 110. The rotation unit cover 148 is coupled to a side surface of the case 110. Preferably, the rotation unit cover 148 is implemented so that a lever moving slot 144 along which the lever 147 moves can be implemented in a state that the rotation unit cover 148 has been coupled to the case 110.

The lever 147 applies a rotational force to the rotation shaft 141 by being driven along the side surface of the case 110.

Accordingly, it is preferable that the lever moving slot 144 is formed to be long in upper and lower directions when viewed from the front surface of the case 110.

The lever 147 is disposed to be exposed to thr front surface of the case 110 so as to be held by a user's hand.

In order to allow a user to easily grasp and rotate the lever 147, an end portion of the lever 147 is preferably provided with an extended lever portion 147*a* elongated in a length direction of the case 110.

In the preferred embodiment, a plurality of the ice trays 130 may be accommodated in the tray accommodation portion 120. In this case, required is an additional structure to simultaneously rotate the plurality of ice trays 130.

It is assumed that the number of the ice trays 130 accommodated in the tray accommodation portion 120 is two.

Figure 12:
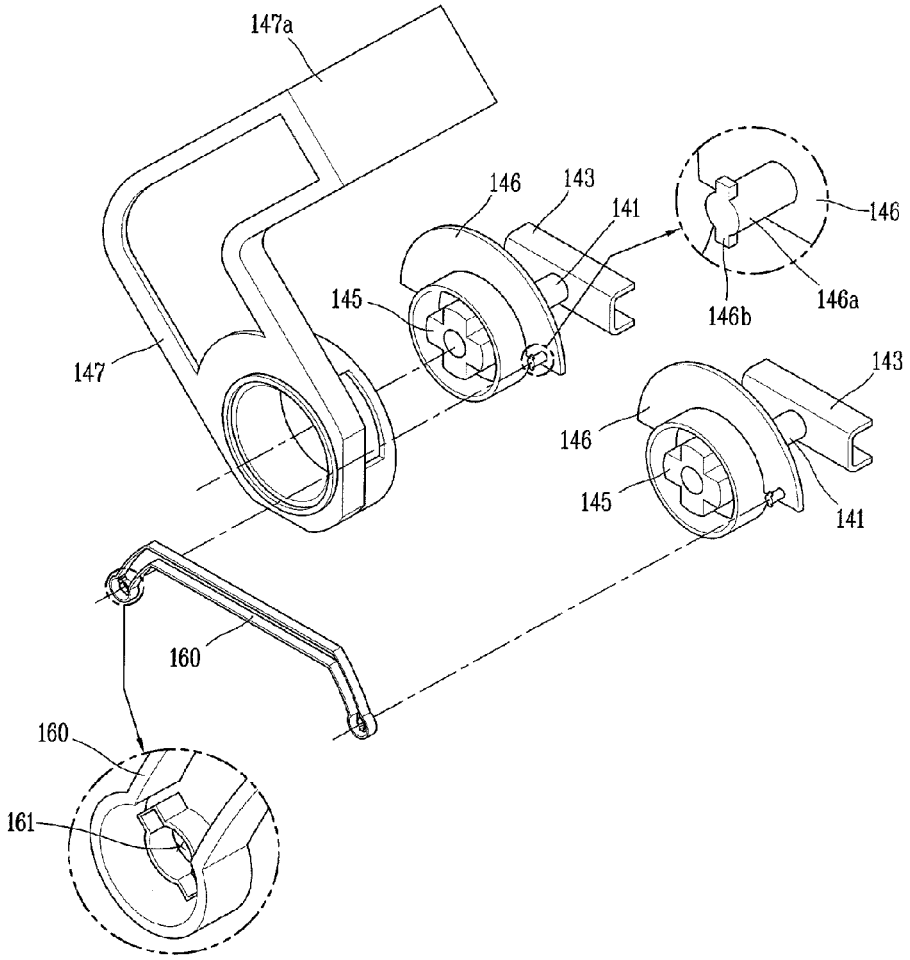
FIG. 12 is a disassembled perspective view showing a tray rotation unit for rotating a plurality of ice trays.
Figure 13:
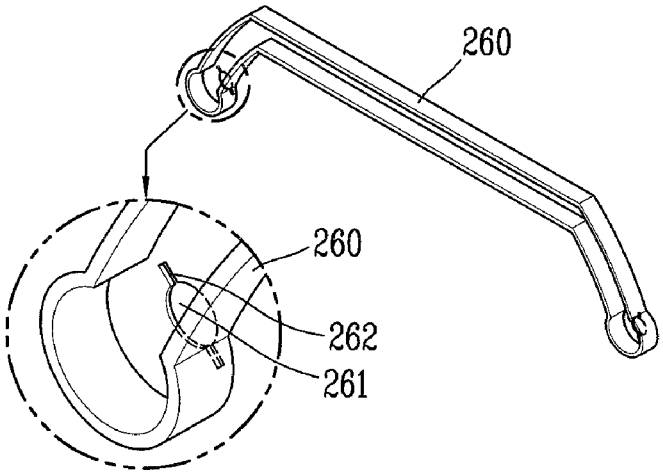
FIG. 13 is a view showing a connection member of the tray rotation unit of FIG. 12 according to one example.
Figure 14:
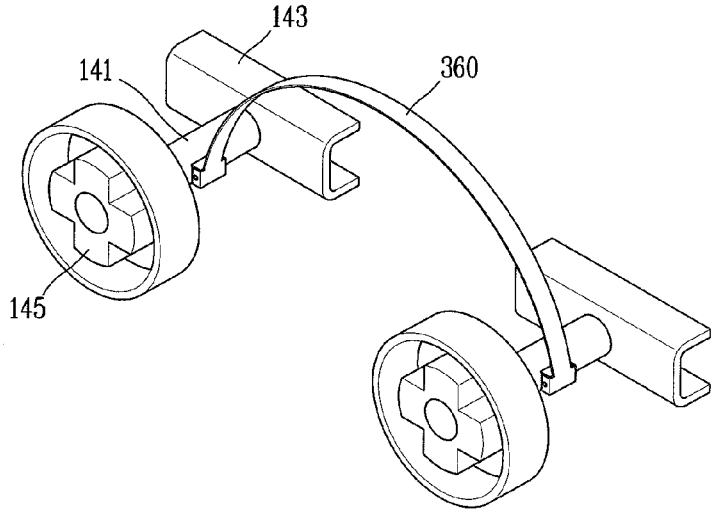
FIG. 14 is a view showing a connection member of the tray rotation unit of FIG. 12 according to another example.

FIG. 12 is a disassembled perspective view showing the tray rotation unit for rotating a plurality of ice trays, FIG. 13 is a view showing an example of a connection member of the tray rotation unit of FIG. 12, and FIG. 14 is a view showing another example of the connection member of the tray rotation unit of FIG. 12.

The two ice trays 130 are sequentially accommodated in the tray accommodation portion 120 in back and forth directions of the case 110.

As aforementioned, each of the ice trays 130 is formed in a rectangular shape, and is accommodated in the tray accommodation portion 120 so that a length direction thereof can be positioned in right and left directions of the case 110.

Each of the ice trays 130 is provided with the rotation protrusions 134*a* and 134*b*, and the rotation limiting protrusions 136*a* and 136*b*. Here, the rotation protrusion 134*a* and the rotation limiting protrusion 136*a* provided on one side surface of the ice tray 130 are connected to each other by the shaft coupling portion 138.

The two ice trays 130 are accommodated in the tray accommodation portion 120 so that the two shaft coupling portions 138 thereof can be positioned on the same side surface of the tray accommodation portion 120.

Two rotation shafts 141 coupled to the two shaft coupling portions 138 are provided on a side surface of the case 110 adjacent to the shaft coupling portions 138. As aforementioned, each of the rotation shafts 141 is provided with the tray coupling portion 143 and the lever coupling portion 145. Preferably, the lever 147 is coupled to the lever coupling portion 145 closer to the front surface of the case 110 between the two lever coupling portions 145.

In the preferred embodiment, a connection member 160 for connecting the two rotation shafts 141 to each other is provided so as to simultaneously rotate the two rotation shafts 141 by rotation of the lever 147.

Preferably, the connection member 160 is implemented as a curved member upwardly convexed so as to prevent interference between itself 160 and the rotation shafts 141 while the rotation shafts 141 are rotated.

Hereinafter, a coupling process between the connection member 160 and the rotation shafts 141 will be explained in more detail with reference to FIGS. 12 to 14.

As shown in FIG. 12, the connection member 160 may be pin-coupled to connection member coupling portions 146 implemented as predetermined regions on outer circumferential surfaces of the lever coupling portions 145 or the rotation shafts 141 are extending in a radius direction of the rotation shafts 141.

Here, the connection member 160 and the connection member coupling portions 146 are pin-coupled to each other in a shaft direction of the rotation shafts 141.

In order to pin-couple the connection member 160 to the connection member coupling portions 146, the connection member coupling portions 146 are provided with fitting protrusions 146*a* protruding in a shaft direction of the rotation shafts 141. And, fitting holes 161 coupled to the fitting protrusions 146*a* are formed at both ends of the connection member 160.

The fitting protrusions 146*a* are formed in a cylindrical shape, and are provided with separation preventing protrusions 146*b* at end portions thereof. The separation preventing protrusions 146*b* are protruding from outer circumferential surfaces of the fitting protrusions 146*a* in a radius direction, and prevent the connection member 160 fitted into the fitting protrusions 146*a* from being separated therefrom.

In order to more effectively prevent separation of the connection member 160 from the fitting protrusions 146*a* while the rotation shafts 141 are rotated, the separation preventing protrusions 146*b* of the fitting protrusions 146*a* provided at the rotation shafts 141 are protruding in different directions from each other.

The fitting holes 161 coupled to the fitting protrusions 146*a* may be formed to have a shape corresponding to that of the separation preventing protrusions 146*b*.

In order to couple the fitting holes 161 into the fitting protrusions 146*a*, the connection member 160 is properly rotated so that the fitting holes 161 can have the same shape as the separation preventing protrusions 146*b*. A process for separating the fitting holes 161 from the fitting protrusions 146*a* is performed in an opposite manner to the aforementioned coupling process.

Under these configurations, the connection member 160 is prevented from being separated from the fitting protrusions 146*a*, and an external force need not be applied so as to detachably mount the connection member 160 to the fitting protrusions 146*a*.

FIG. 13 is a view showing a connection member 260 of the tray rotation unit of FIG. 12 according to one example.

As shown in FIG. 13, fitting holes 261 coupled to the fitting protrusions 146*a* are formed in a circular shape. And, the connection member 260 may be provided with cut-out portions 262 radially cut-out from the circumferences of the fitting holes 261 for transformation of the fitting holes 261.

Once the fitting holes 261 are pushed toward a shaft direction of the fitting protrusions 146*a* with contacting upper surfaces of the separation preventing protrusions 146*b*, the cut-out portions 262 are widened. At the same time, the fitting holes 261 are fitted into the fitting protrusions 146*a* by having an increased diameter. After the fitting holes 261 have passed through the separation preventing protrusions 146*b*, the cut-out portions 262 are restored to the original positions. Accordingly, the connection member 260 is prevented from being separated from the fitting protrusions 146*a*.

FIG. 14 is a view showing a connection member 360 of the tray rotation unit of FIG. 12 according to another example.

As shown in FIG. 14, both ends of the connection member 360 may be pin-coupled to outer circumferential surfaces of the rotation shafts 141 in a shaft direction. This may simplify the coupling of the connection member 360 to the rotation shafts 141.

In the present invention, the ice making device 100 may further include a structure to store ice cubes made in the ice tray 130.

Figure 15:
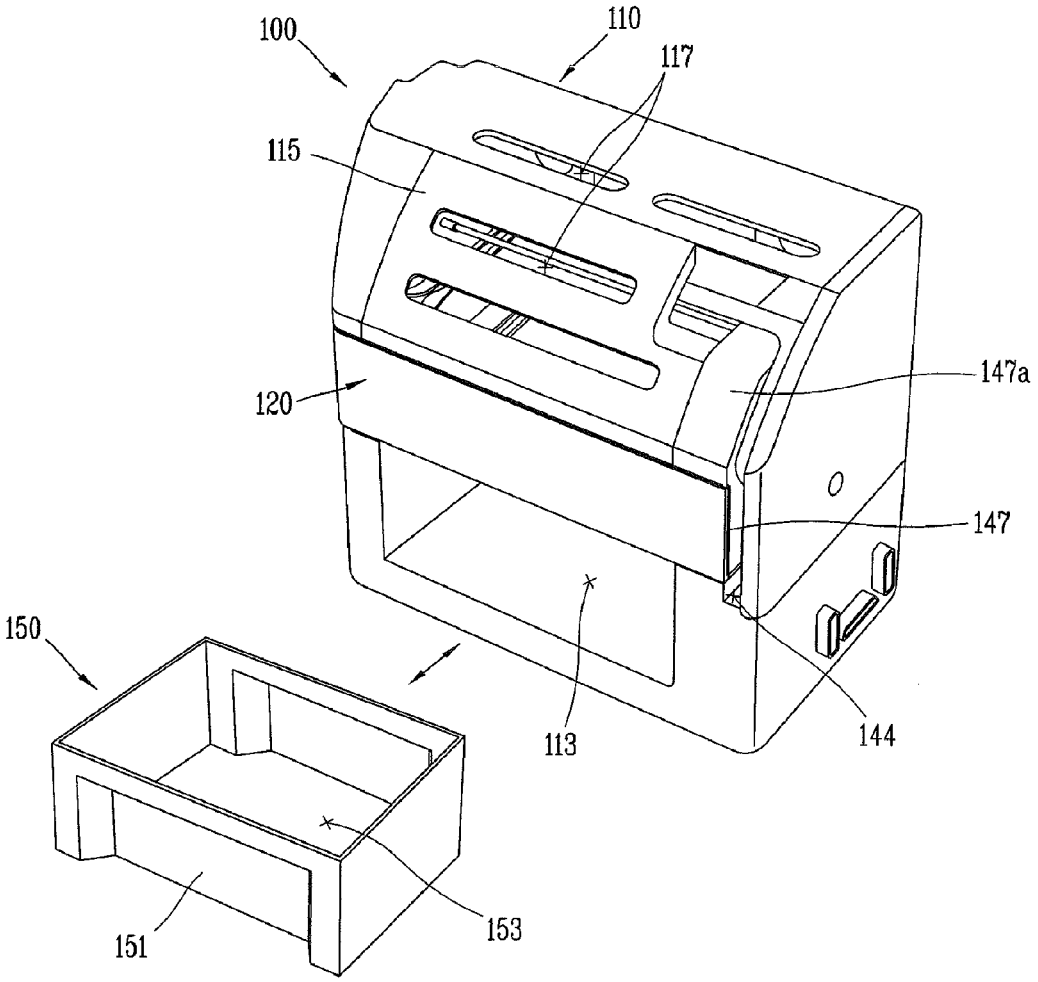
FIG. 15 is a view showing a state that an ice-cube storage container of FIG. 2 is inserted into or withdrawn from the case.

FIG. 15 is a view showing a state that an ice-cube storage container of FIG. 2 is inserted into or withdrawn from the case 110.

Referring to FIG. 15, the ice making device 100 further includes an ice-cube storage container 150 disposed below the tray accommodation portion 120 and storing ice cubes separated from the ice tray 130 therein.

The ice-cube storage container 150 is disposed so as to be inserted into or withdrawn from the case 110.

The ice-cube storage container 150 may be provided with a handle 151 held by a user's hand when inserted into or withdrawn from the case 110. The ice-cube storage container 150 may be further provided with a storage amount checking portion 153 formed of a transparent material and configured to allow a user to check, from the outside, an amount of ice cubes store in the ice-cube storage container 150.

Hereinafter, the door 12 of the refrigerator 10 having the ice making device 100 will be explained in more detail.

Figure 16:
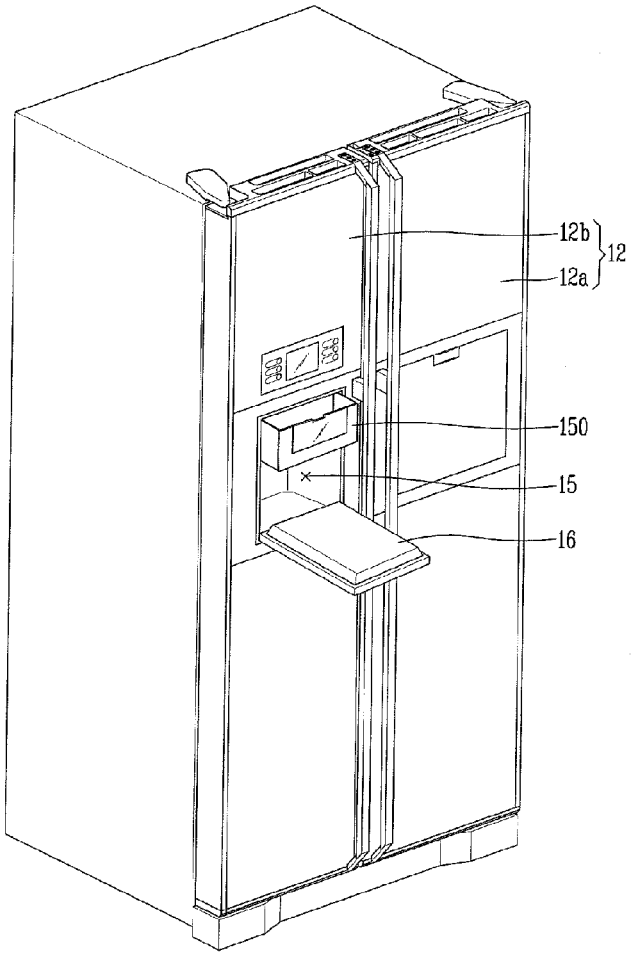
FIG. 16 is a perspective view showing a front surface of a door having an ice making device according to a first embodiment of the present invention.
Figure 17:
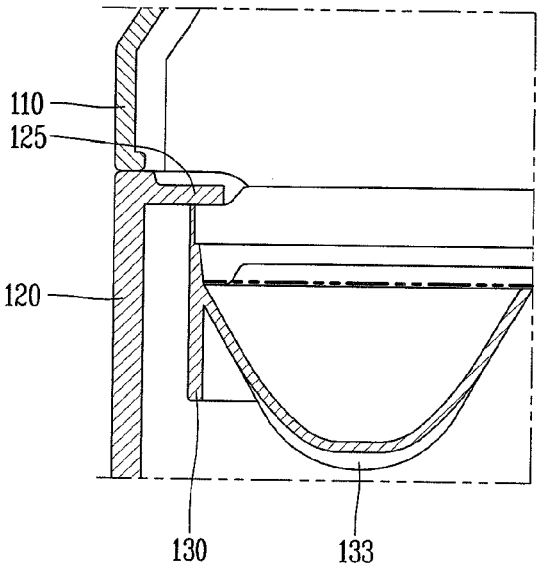
FIGS. 17 and 18 are sectional views showing main parts of the ice tray and the tray accommodation portion in a state that the ice tray has been accommodated in the tray accommodation portion.
Figure 18:
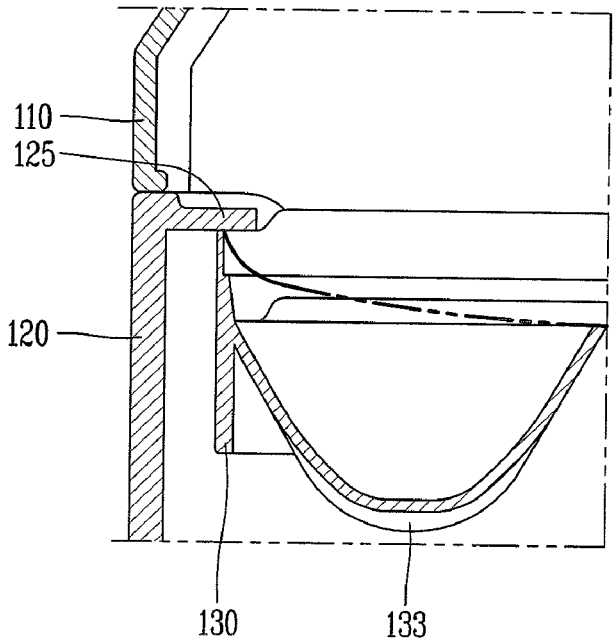

FIG. 16 is a perspective view showing a front surface of the door 12 having the ice making device 100 according to a first embodiment of the present invention, and FIGS. 17 and 18 are sectional views showing main parts of the ice tray 130 and the tray accommodation portion 120 in a state that the ice tray 130 has been accommodated in the tray accommodation portion 120.

Referring to FIG. 16, the ice making device 100 is installed on a rear surface of the door 12 of the refrigerator 10, i.e., a surface toward the storage chamber 11.

Generally, the ice making device 100 for making ice cubes is installed at the freezing chamber door 12*b*. However, the ice making device 100 may be also installed at the refrigerating chamber door 12*a* if the refrigerating chamber door 12*a* is provided with a space partitioned from the refrigerating chamber 11*a* and having the ice making device 100 installed therein, and if the space is controlled to have the same temperature circumstance as that of the freezing chamber 11*b*.

In the present invention, the ice making device 100 conventionally installed in the refrigerating chamber 11*a* or the freezing chamber 11*b* and resulting in decrease of an inner capacity of the refrigerator 10 is installed at the door 12. Accordingly, the inner capacity of the refrigerator 10 is increased.

The door 12 is provided with a withdrawing opening 15 penetratingly formed at the door 12 so that the ice-cube storage container 150 can be withdrawn out regardless of an opening or closing process of the door 12. The door 12 is also provided with an ice-cube withdrawing door 16 for opening and closing the withdrawing opening 15. The ice-cube withdrawing door 16 serves to prevent cool air from leaking through the withdrawing opening 15.

Preferably, the ice-cube storage container 150 is disposed so as to be inserted into or withdrawn from the case 110, through the withdrawing opening 15, in back and forth directions of the case 110.

In the present invention, since the ice making device 100 is installed at the door 12, an external force and vibration applied to the ice tray 130 accommodated in the ice making device 100 may be increased while the door 12 is opened or closed. This may cause water contained in the ice tray 130 to overflow. In order to solve this problem, as shown in FIGS. 17 and 18, the tray accommodation portion 120 may be further provided an adhesion member 125 extending from a front upper end thereof to a rear surface thereof by a predetermined length, and adhered to an upper end of the ice tray 130.

As shown in FIG. 18, when water contained in the ice tray 130 moves in any directions due to an external force, the adhesion member 125 prevents the water from overflowing from the ice tray 130.

Especially, the adhesion member 125 can prevent the water from overflowing to a front side of the tray accommodation portion 120, and thus from splashing into the freezing chamber 11*b*.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. An ice making device for a refrigerator, the ice making device comprising:

a tray accommodation portion having open upper and lower surfaces;

a plurality of ice trays sequentially accommodated in the tray accommodation portion in parallel to each other, and configured to accommodate therein water to be frozen to ice cubes;

rotation protrusions provided at both sides of each of the plurality of ice trays in a lengthwise direction of each of the plurality of ice trays and rotatably-coupled to the tray accommodation portion;

fitting protrusions each provided at one side of each of the plurality of ice trays, spaced from the corresponding rotations protrusions in a widthwise direction of each of the plurality of ice trays, and configured to be rotated together with each of the plurality of ice trays;

a lever formed to be rotatable by manipulation, and configured to apply a rotational force to the ice trays; and linkage arm connected to each of the fitting protrusions such that the plurality of ice trays is rotated together when the lever is driven, wherein the linkage arm includes:

fitting holes formed in the linkage arm to accommodate the fitting protrusions, respectively; and cut-out portions radially cut-out from circumferences of the fitting holes, respectively, such that the fitting protrusions are fitted into the fitting holes by deformation of the cut-out portions.

2. The ice making device of claim 1, wherein the fitting holes are formed at each of two ends of the linkage arm.

3. The ice making device of claim 1, wherein the fitting protrusions extend in parallel to the rotation protrusions, and wherein the fitting holes and the fitting protrusions are coupled to each other in a direction parallel to a shaft direction of the rotation protrusions.

4. The ice making device of claim 1, further including a plurality of coupling portions coupled to the plurality of the ice trays, respectively, wherein each of the plurality of coupling portions includes a linkage arm coupling portion, wherein the fitting protrusions protrude from the linkage arm coupling portions, respectively, and wherein the linkage arm coupling portions are formed as semicircular surfaces that extend radially from radial shafts of the plurality of coupling portions, respectively, which extend coaxial with the rotation protrusions.

5. The ice making device of claim 4, wherein each of the plurality of ice trays rotates at least 180 degrees.

6. The ice making device of claim 1, wherein a separation preventing protrusion protrudes from an outer circumferential surface of each of the fitting protrusions at an end portion of each of the fitting protrusions in a radial direction, so as to prevent separation of the linkage arm when the linkage arm is coupled to the fitting protrusions.

7. The ice making device of claim 1, wherein the linkage arm has an upwardly convex shape, for prevention of mechanical interference between the linkage arm and the plurality of ice trays occurring when the plurality of ice trays is rotated.

8. The ice making device of claim 1, wherein each of the plurality of ice trays includes:

a plurality of ice pockets each configured to make a single ice cube by accommodating water therein; and pocket communication portions configured to supply water contained in any one of the plurality of ice pockets with a height more than a predetermined height to adjacent ice pockets.

9. The ice making device of claim 8, wherein the pocket communication portions are grooves formed at an upper end of partition portions that partition the adjacent ice pockets from each other.

10. The ice making device of claim 8, further including at least one discharge portion formed in at least one of the plurality of ice pockets, and at least one drain guide rib formed on an underside of each of the plurality of ice trays, wherein the at least one drain guide rib communicates with the at least one discharge portion to discharge excess water.

11. The ice making device of claim 1, wherein the ice making device further includes:

a case having an opening at one side thereof, such that the tray accommodation portion is accommodated there into or withdrawn therefrom through the opening; and an accommodation portion coupling device configured to couple the tray accommodation portion to the case, wherein the accommodation portion coupling device comprises a locking protrusion formed at one of the tray accommodation portion or the case, and a locking hook formed at the other one of the tray accommodation portion or the case.

12. The ice making device of claim 1, wherein the ice making device further includes an ice cube storage container positioned below the tray accommodation portion, and configured to accommodate therein ice cubes separated from the ice trays.

13. The ice making device of claim 12, wherein the ice cube storage container includes a transparent storage amount checking portion through which an amount of ice cubes stored therein is recognizable from outside of the ice making device.

14. The ice making device of claim 1, wherein the plurality of ice trays is sequentially accommodated in the tray accommodation portion in a horizontal direction.

15. A refrigerator, comprising:

a refrigerator main body having a freezing chamber and a refrigerating chamber;

a freezing chamber door to open and close the freezing chamber;

the ice maker of claim 1 disposed at a rear surface of the freezing chamber door and having an ice cube storage container to store ice cubes made by the ice maker; and an opening provided at the freezing chamber door so that the ice cube storage container can be withdrawn regardless of whether the freezing chamber door is opened or closed.

16. The ice making device of claim 1, wherein the cut-out portions are configured to widen the fitting holes by being widened when the fitting protrusions are inserted into the fitting holes.

17. The ice making device of claim 1, wherein each of the fitting protrusions includes at least one separation preventing protrusion that protrudes from an outer circumferential surface of the fitting protrusion in a radial direction, that prevents a separation of the linkage arm from the respective fitting protrusion.

18. An ice making device for a refrigerator, the ice making device comprising:

a tray accommodation portion having open upper and lower surfaces;

a plurality of ice trays sequentially accommodated in the tray accommodation portion in parallel to each other, and configured to accommodate therein water to be frozen to ice cubes;

rotation protrusions provided at both sides of each of the plurality of ice trays in a lengthwise direction of each of the plurality of ice trays, and rotatably-coupled to the tray accommodation portion;

fitting protrusions provided at one side of each of the plurality of ice trays, spaced from the corresponding rotation protrusions in a widthwise direction of each of the plurality of ice trays, and configured to be rotated together with each of the plurality of ice trays, a lever formed to be rotatable by manipulation, and configured to apply a rotational force to the ice trays; and a linkage arm connected to each of the rotation protrusions such that the plurality of ice trays is rotated together when the lever is driven, wherein openings are formed in the linkage arm to accommodate the fitting protrusions, respectively, and wherein the fitting protrusions are configured to be fitted into the openings by deformation of the openings, respectively.

* * * * *